US007267054B2

(12) United States Patent
Lien

(10) Patent No.: US 7,267,054 B2
(45) Date of Patent: Sep. 11, 2007

(54) TELESCOPIC MULTI-COLOR INKPAD ASSEMBLY WITH EASY-DEMOUNTABLE-AND-ASSEMBLED INKPAD BASES

(75) Inventor: Yun Dien Lien, Keelung (TW)

(73) Assignee: Yi Yao Co., Ltd., Anle Chiu, Keelung (TW)

( * ) Notice: Subject to any disclaimer, the term of this patent is extended or adjusted under 35 U.S.C. 154(b) by 0 days.

(21) Appl. No.: 11/090,281

(22) Filed: Mar. 28, 2005

(65) Prior Publication Data

US 2006/0090659 A1 May 4, 2006

(30) Foreign Application Priority Data

Nov. 2, 2004 (TW) ..... 2004200945968 U
Mar. 7, 2005 (TW) ..... 94203512 U

(51) Int. Cl.
*B41K 1/42* (2006.01)

(52) U.S. Cl. ..... 101/333; 101/327

(58) Field of Classification Search ..... 101/97, 101/101, 104, 108, 327, 333, 405, 406
See application file for complete search history.

(56) References Cited

U.S. PATENT DOCUMENTS 5,313,885 A * 5/1994 Winston ..... 101/405
5,505,130 A * 4/1996 Winston ..... 101/333
5,636,569 A * 6/1997 Winston ..... 101/333

* cited by examiner

*Primary Examiner*—Ren Yan
(74) *Attorney, Agent, or Firm*—Bacon & Thomas PLLC

(57) ABSTRACT

The present invention is to provide a telescopic multi-color inkpad assembly with easy-demountable-and-assembling inkpad bases. The inkpad base can be freely demounted from and assembled to the base so that it is convenient for the user to grasp the inkpad. Color-staining problem between two neighboring inkpads is prevented and the base can freely extend to open and contract to close causing variant configurations and shapes.

7 Claims, 10 Drawing Sheets

FIG.. 2a

TELESCOPIC MULTI-COLOR INKPAD ASSEMBLY WITH EASY-DEMOUNTABLE-AND-ASSEMBLED INKPAD BASES

BACKGROUND OF THE INVENTION

1. Field of the Invention

The present invention relates in general to a multi-color inkpad assembly for use in seal, painting, or children painting education tool. In particular, the present invention relates to a telescopic multiple inkpad assembly that is equipped with easy-demountable-and-assembled inkpad bases.

2. Description of the Related Art

In everyday lives, the inkpad is used as an auxiliary tool for seal stamping, for example, a repeatable-used stamping mark, the oriental personal seal and so on. Thus, the color of ink paste is relatively simple and is, generally, in the scope of red, black and blue color. However, if an inkpad assembly is provided with multi-color assembled inkpads, it is possible to use as a painting tool or a children painting education tool.

A conventional multi-color inkpad assembly, for example, the multi-color inkpad assembly (a) described in U.S. Pat. No. 5,636,569 is provided with eight similar inkpad assemblies (as shown in FIG. 1). Each inkpad assembly contains an absorbent pad (b1) integrated with ink for use in inkpad, an inkpad base (b2) that contains a plate (b21) for loading the inkpad (b1), several junctures (b22) that are perpendicular to the plate (b21), and a base (b3) that contains several slots (b31) each corresponding to a juncture (b22). The shape of the base (b3) corresponds to the shape of the inkpad base (b2) and the inkpad base (b2) is demountable from and assembled-able to the base (b3) by way of the prescribed axles of junctures (b22) and slots (b31). A user can apply the color of inkpad to a canvas by handing the inkpad base (b2). Multiple inkpads (a) are manually assembled into a multi-color inkpad base.

However, several problems are found when the conventional multi-color inkpad assembly (a) is used, for example:

(1) the absorbent pads (b1) are adjoined together without intervals between each other so that different colors may spread to each other between each two adjoined absorbent pads resulting to a color staining problem;

(2) the inkpad base (b2) for loading the absorbent pads (b1) is in plate-configuration so that when the ink absorbing ability of absorbent pad (b1) is over-loaded the problem of color staining between each two adjoined inkpads still exists and the unabsorbed ink from the inkpads will move downward to stain the base causing a cleaning problem; and (3) when the inkpad base (b2) (including the absorbent pads (b1)) is removed from the base (b3), though, the user may apply the colors in the inkpads to a canvas by handing the inkpad base (b2), only the juncture (b22) is graspable, such that the force-applying points are few and the force-applying area is little resulting to color staining to hands, thus, it is especially unsuitable for children painting education.

Therefore, the conventional multi-color inkpad assembly (a) contains a using problem caused by the problem of demountable equipments.

SUMMARY OF THE INVENTION

Accordingly, the present invention is to provide a telescopic multi-color inkpad assembly with easy-demountable-and-assembled inkpad bases. The inkpad bases can be freely demounted from and assembled to the base so that it is convenient for the user to grasp the inkpad bases. Color-staining problem between two adjoined inkpads is prevented and the base can freely extend to open and contract to close causing variant configurations and shapes.

The main object of the present invention is to provide a telescopic multi-color inkpad assembly with easy-demountable-and-assembled inkpad bases which assembly contains inkpad bases. Each inkpad base is a hollow cubic receptacle formed by cooperative bottom plates and side plates. A slit or a protrusion is formed on an outside face of each of more than one side plates to form a sliding trail. When each two inkpads are joined together the side plates of the inkpad bases can prevent different colors in neighboring inkpads from mutually staining. An inkpad is mounted in the hollow receptacle. A base is provided with side plates to form a hollow slot with a configuration corresponding to the configuration of the hollow receptacles of the inkpad bases. More than one side plates on the base are provided with a protrusion or a slit on inside face of the base to correspond to the protrusion or slit on the outside face of the inkpad base to serve as a sliding trail so that the inkpad bases can be freely demounted or assembled along the axis direction of the sliding trail. A cover is shaped to have a configuration corresponding to the configuration of the inkpad base to prevent evaporation of the ink in the inkpad. The bottom and side plates of the inkpad base can serve as force-applying parts allowing user's fingers to grasp helping the user to conveniently operate the inkpad to apply the color to the canvas and prevent color staining from hands of the user.

Another object of the present invention is to provide a telescopic multi-color inkpad with easy-demountable-and-assembled inkpad bases. The base of the inkpad assembly contains more than three upper plates. Each upper plates contains a hollow slot that is formed by upward protruding side plates of the base and is so shaped to correspond to the configuration of the inkpad bases. A protrudance or a slot is formed on the inside face facing the hollow slot by the side plates of the base and is so shaped to correspond to the shape of the slits or the protrusions of the extended side plates on the outside face of the inkpad bases to serve as a sliding trail. Therefore, the inkpad bases can be freely demounted or assembled along the sliding trail in an axis direction. The base of each upper plates further contains a first axle, a second axle and a third axle. Each of more than three lower plates contains a first axle, a second axle and a third axle. Each upper plate cooperates with three lower plates by way of connecting the first axle of the upper plate to the first axle of the first lower plate to form a first rotatable axle, the second axle of the upper plate to the second axle of the second lower plate to form a second rotatable axle, and the third axle of the upper plate to the third axle of the third lower plate to form a third rotatable axle. The upper plates and lower plates of the so-assembled base are inter-connected so that when the axle rotates the base will extend outward to open or contract inward to close according to the upper and the lower plates. Accordingly, when the inkpad assembly outwardly extends the user can conveniently grasp it to demount or assemble the inkpad bases; and when the inkpad assembly is inwardly close the inkpad assembly is convenient to carry and contains esthetics by variant patterns.

DESCRIPTION OF THE DRAWINGS

The present invention can be more fully understood by reading the subsequent detailed description and examples with references made to the accompanying drawings, wherein:

FIG. 2*a* is a perspective view of an inkpad assembly according to one embodiment of the invention;

DETAILED DESCRIPTION OF THE PREFERRED EMBODIMENT

The structures, the objects and effects of the telescopic multi-color inkpad assembly with easy-demountable-and-assembled inkpad bases according to the invention will be detailedly described by the following embodiment.

Figure 1:
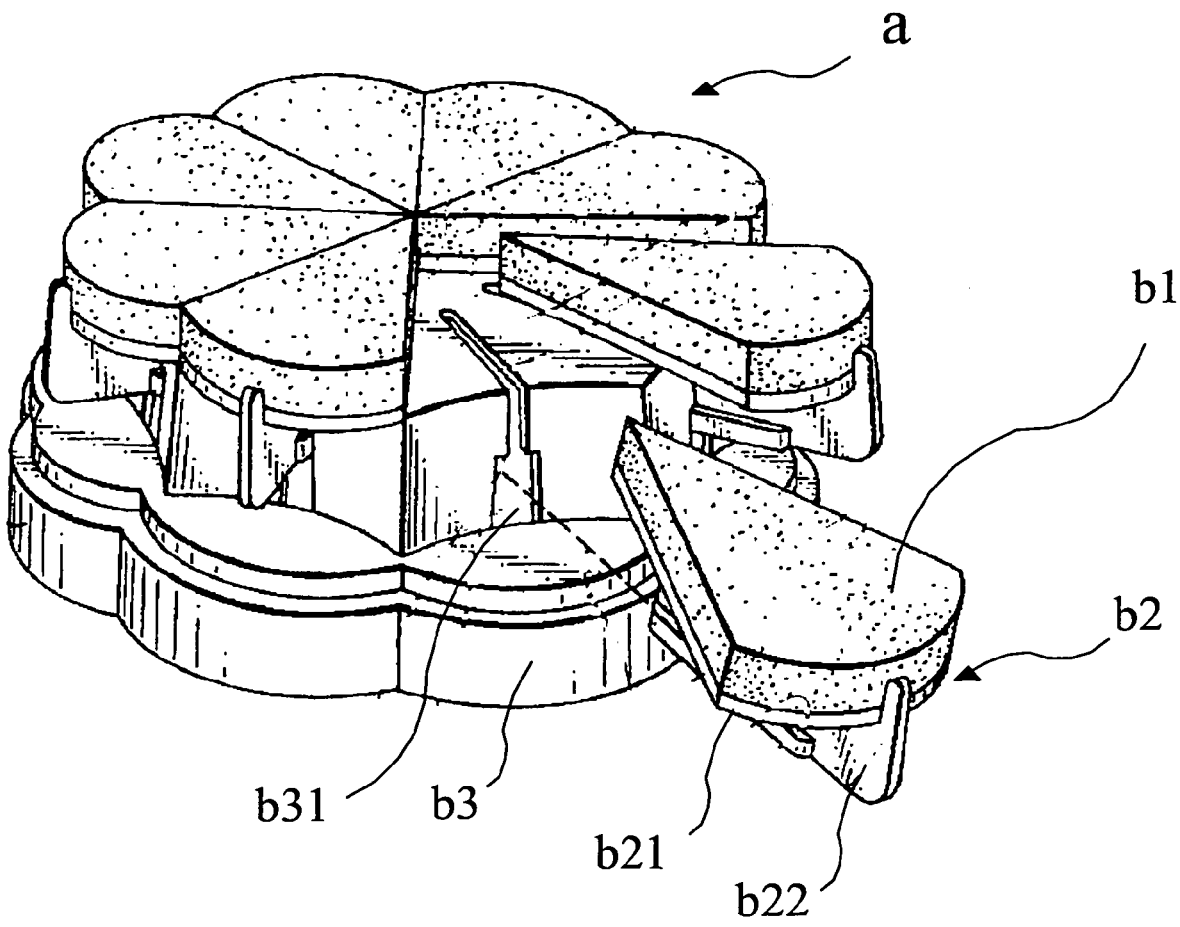
FIG. 1 (PRIOR ART)
FIG. 1 is a perspective view of a conventional inkpad assembly.
Figure 2B:
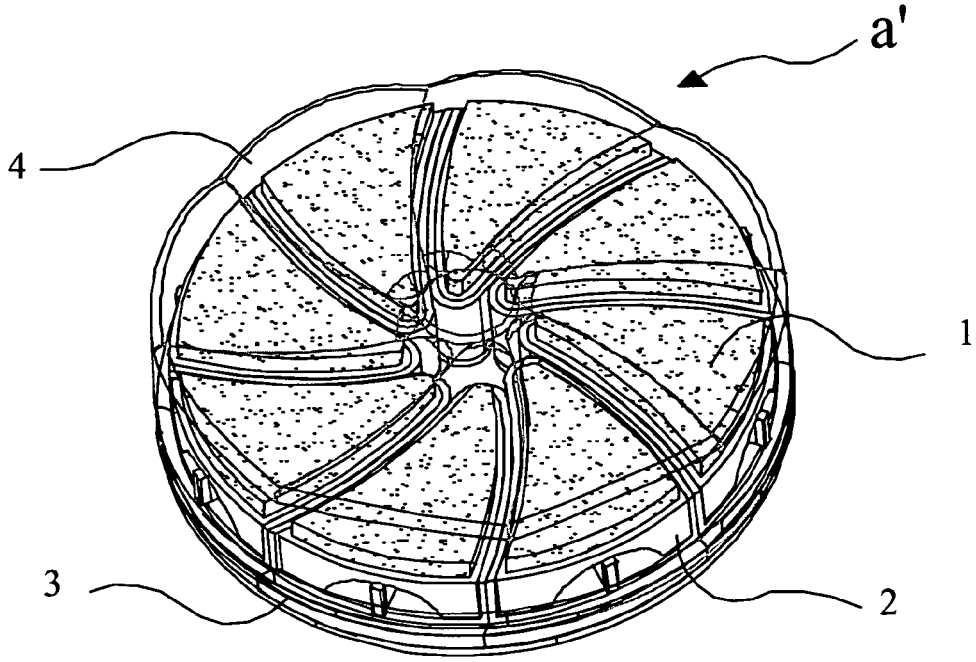
FIG. 2*b* is a perspective view showing that the inkpad bases together with the inkpads according to one embodiment of the present invention is demounted from the base.
Figure 2B:
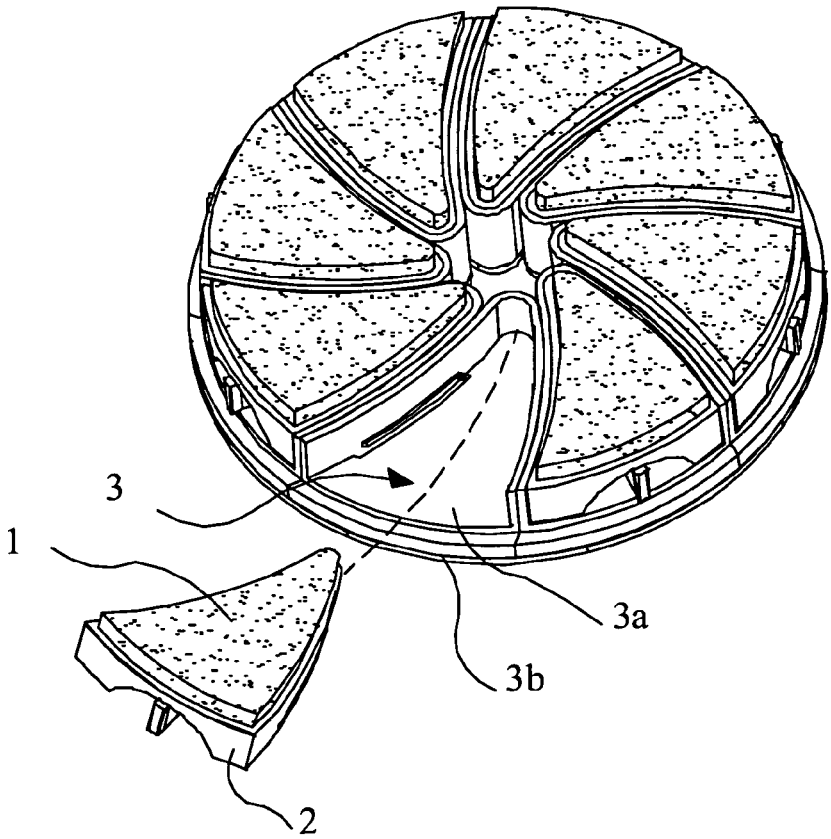
Figure 3:
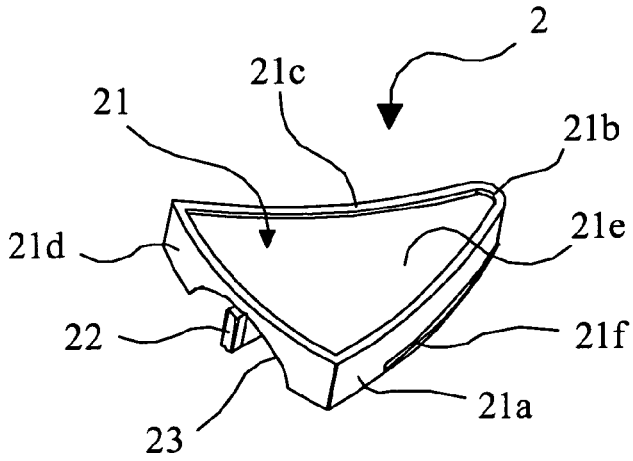
FIG. 3 is a perspective view of an inkpad base according to one embodiment of the invention.
Figure 4A:
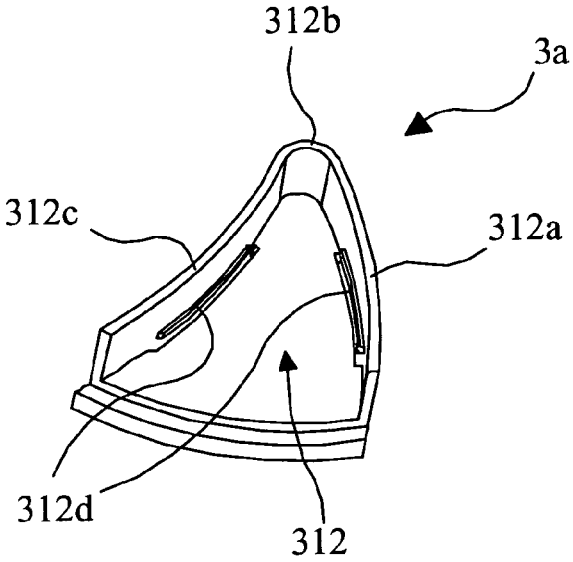
FIG. 4*a* is a perspective view of an upper plate of the base according to one embodiment of the invention.
Figure 4B:
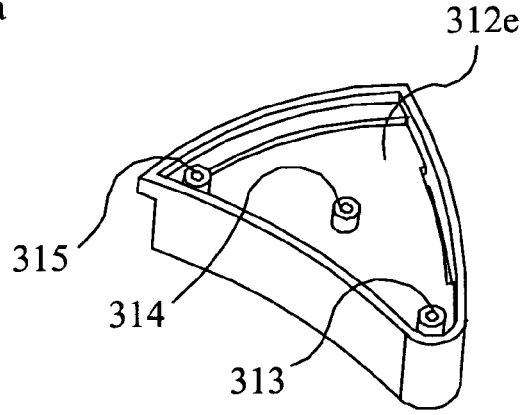
FIG. 4*b* is a perspective view of another upper plate of the base according to one embodiment of the invention.
Figure 5:
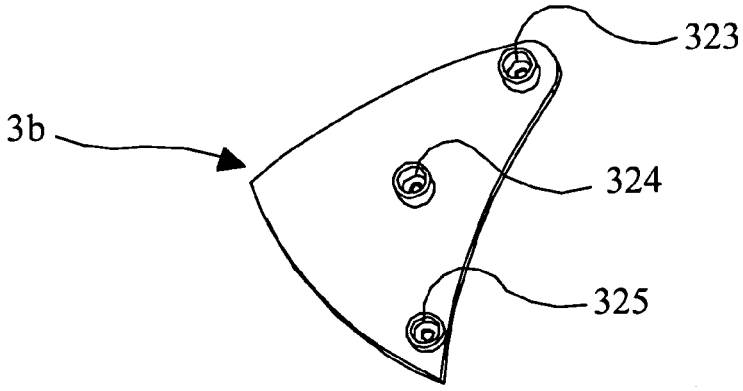
FIG. 5 is a perspective view of a lower plate according to one embodiment of the invention.
Figure 6A:
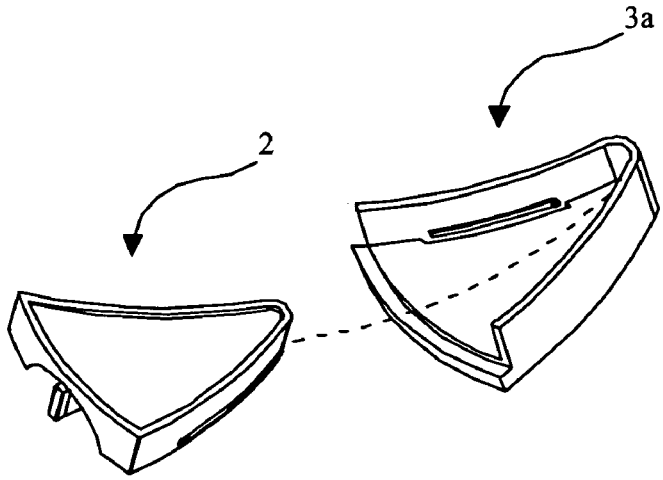
FIG. 6*a* is a perspective view showing the inkpad bases and the lower plates of the base according one embodiment of the invention.
Figure 6B:
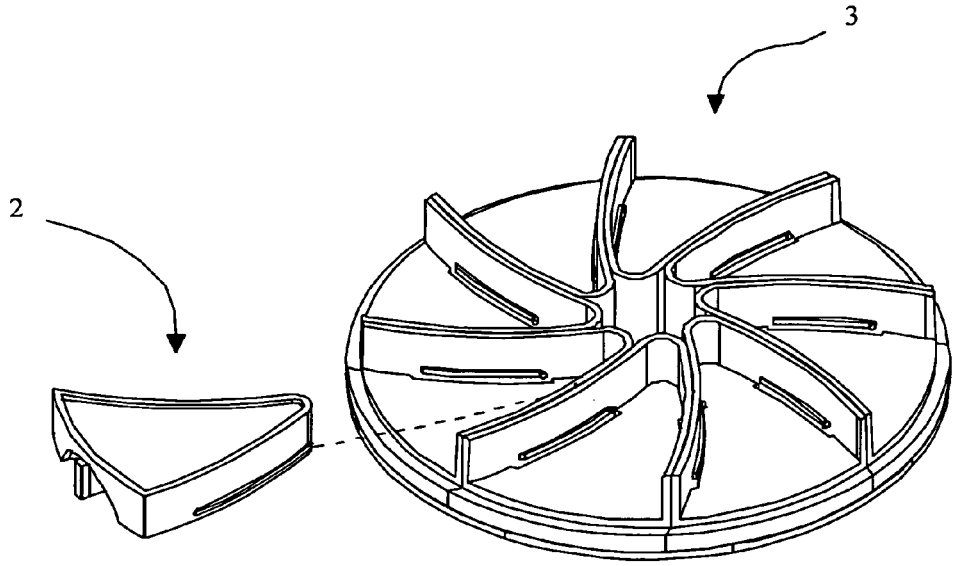
FIG. 6*b* is a perspective view of several bases after being assembled according to one embodiment of the invention.
Figure 7A:
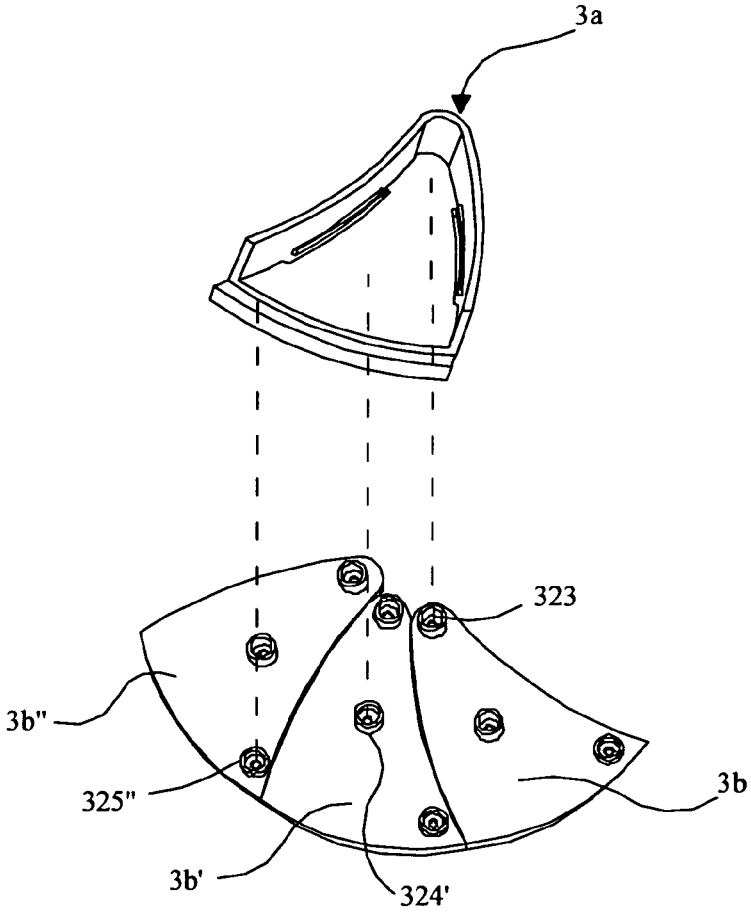
FIG. 7*a* is a perspective view of the assembled upper plate's and lower plates' axles of the base according to one embodiment of the invention.
Figure 7B:
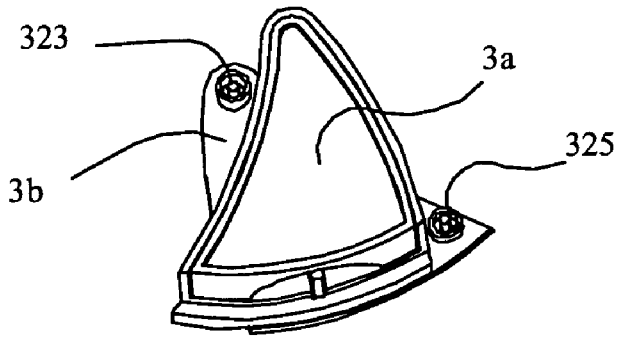
FIG. 7*b* is a perspective view of the assembled upper plate's and lower plates' axles of the base according to another embodiment of the invention.
Figure 7C:
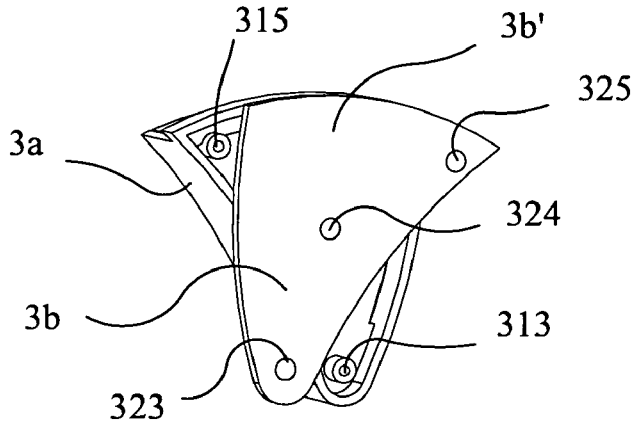
FIG. 7*c* is a perspective view of the assembled upper plate's and lower plates' axles of the base according to another embodiment of the invention.
Figure 8:
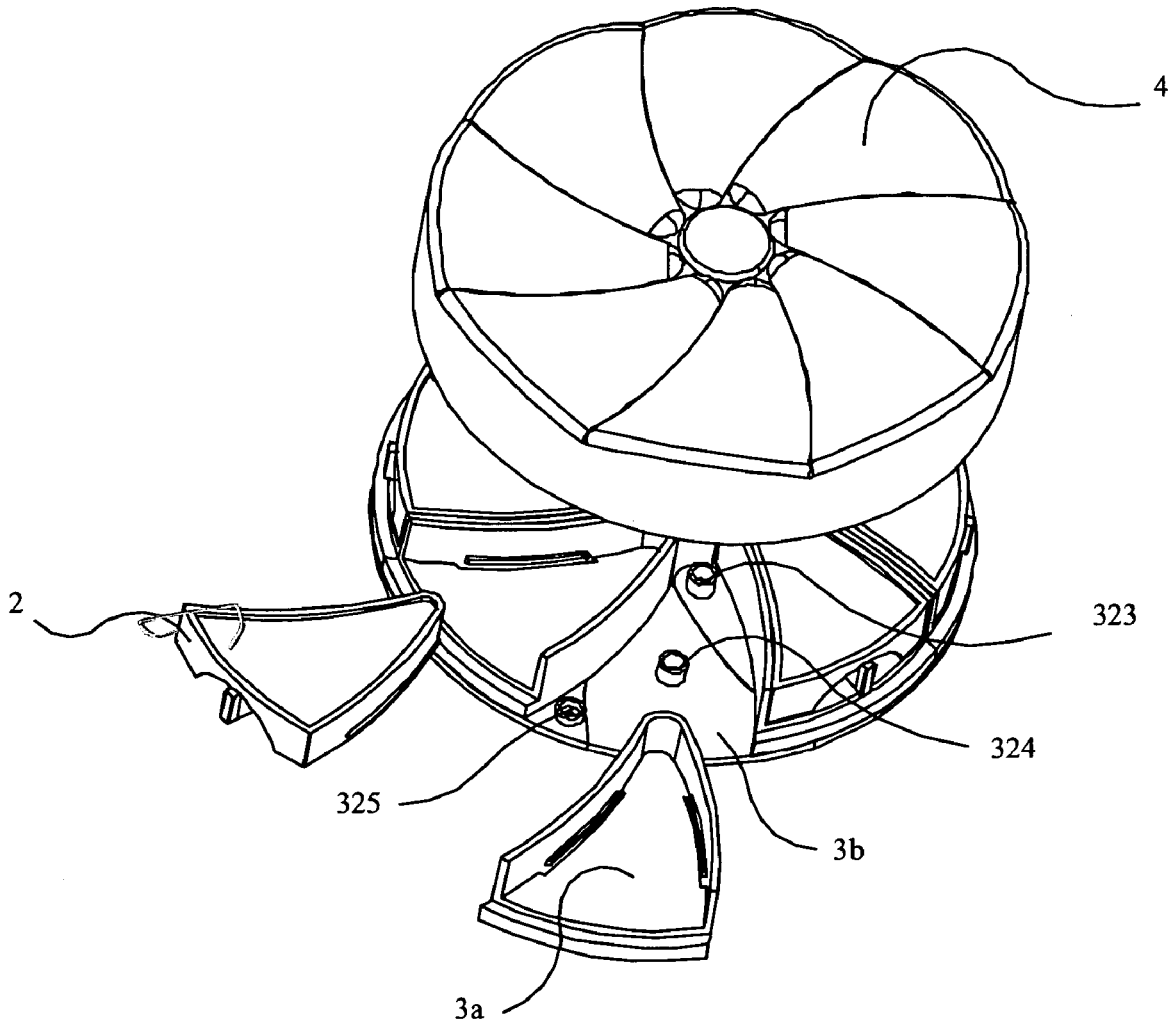
FIG. 8 is an exploded view showing an inkpad assembly according to one embodiment of the invention.

Referring to FIG. 2*a*, the telescopic multi-color inkpad assembly with easy-demountable-and-assembled inkpad bases (a') according to the invention contains inkpad bases (2), inkpads (1) so shaped to correspond to the configuration of hollow receptacles (21) of inkpad bases (2) (as shown in FIG. 3), base (3) that contains upper plate (3*a*) and lower plates (3*b*) (as shown in FIG. 4*a*, 4*b* and 5) and cover (4). The inkpad bases (2) can be demounted from or assembled to the base (3) in a prescribed axis direction (as shown in FIG. 3*b*), Each inkpad base (2) contains a bottom plate (21*e*) that forms a cubic-shaped hollow receptacle (21) by cooperating with neighboring side plates (21*a*), (21*b*), (21*c*) and (21*d*). A slit (21*f*) is formed on an outside face of each plate (21*a*) and (21*c*). A curved recession (23) is formed on side plate (21*d*). A protrusion (22) is formed in curved recession (23) (as shown in FIG. 3). Base (3) contains upper plate (3*a*) and lower plates (3*b*). A hollow slot (312) is formed on upper plate (3*a*) by cooperating bottom plate (312*e*) with side plates (312*a*), (312*b*) and (312*c*) and is so shaped to correspond to the configuration of inkpad base (2). A protrudance (312*d*) is formed on an inward face of each side plates (312*a*) and (312*c*) to correspond to slit (21*f*) on the outside face of each side plate (21*a*) and (21*c*) of inkpad bases (2) and serves as a sliding trail. Inkpad bases (2) can be freely demounted from or assembled to upper plate (3*a*) or the assembled base (3') along the sliding trail in a prescribed axis direction (as shown in FIG. 6*a* and FIG. 6*b*). First, second and third axles (313), (314) and (315) are formed on an outside face (312*e*) of bottom plate (312) of upper plate (3*a*) in cylindrical configuration (as shown in FIG. 4*a* and FIG. 4*b*). A face of each lower plate (3*b*) contains first axle (323), second axle (324) and third axle (325) so shaped in hollow cylindrical configuration to correspond to the configuration of the axles' configuration of upper plate (3*a*) (as shown in FIG. 5). Upper plate (3*a*) cooperates with three lower plates (i.e. lower plate (3*b*) and neighboring lower plates (3*b*') and (3*b*"')) to form a first rotatable axle (not shown) by connecting first axis (313) of upper plate (3*a*) to first axis (323) of first lower plate (3*b*), a second rotatable axle (not shown) by connecting second axle (314) of upper plate (3*a*) to second axle (324') of second lower plate (3*b*'), and third rotatable axle (not shown) by connecting third axle (315) of upper plate (3*a*) to third axle (325") of third lower plate (3*b*") (as shown in FIG. 7*a*, 7*b* and 7*c*). In case that one lower plate (3*b*) cooperates with three upper plates (3*a*), the connecting way is similar. The telescopic inkpad assembly (a') according to the invention (as shown in FIG. 8) is formed by mutually cooperated inkpad (1), inkpad bases (2), base (3) and cover (4) by arranging and assembling them.

Figure 2C:
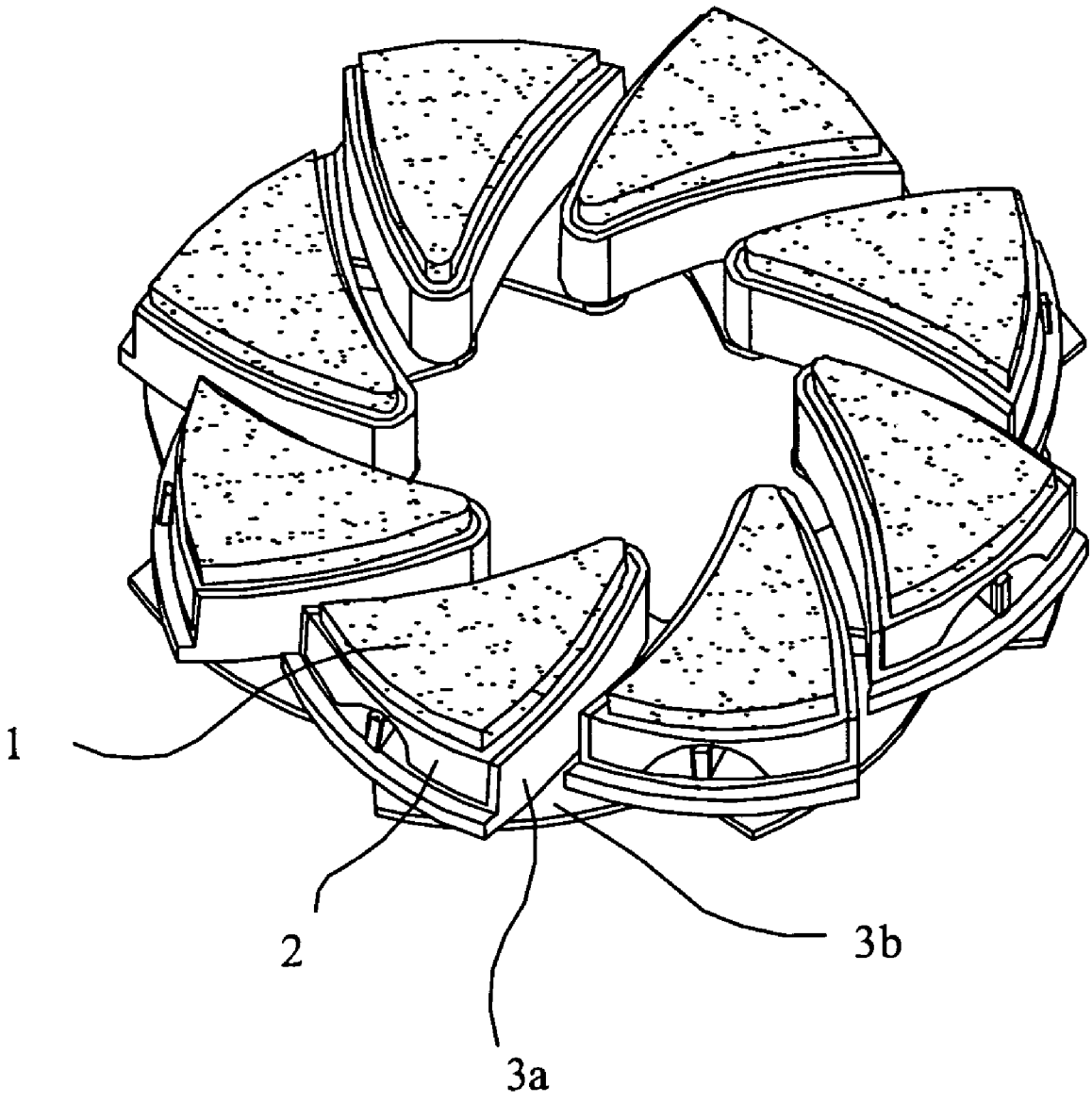
FIG. 2*c* is a perspective view showing that an inkpad assembly according to one embodiment of the invention extends outward to open.

Accordingly, each inkpad base (2) cooperates with inkpad (1), upper plate (3*a*) of base (3) and cover (4) to form an independent single-color inkpad assembly (a') (as shown in FIG. 2*a* and FIG. 2*b*). A user can freely demount or assemble inkpad bases (2) to base (3) along a prescribed axis direction of the sliding trail formed by slit (21*f*) on inkpad bases' two side plates (21*a*) and (21*c*) and protrudance (312*d*) of side plates (312*a*) and (312*c*) of base (3) by applying force on the curved recession (23) and protrusion (22) of side plates (21*d*) (as shown in FIG. 6*a*). As shown in FIG. 2*a*, the curved fan-shaped inkpad bases (2) can form the shape of the inkpad assembly according to the invention by inter-arrangement. Inkpad bases (2) can be freely demounted from base (3) (as shown in FIG, 2*b*). The inkpad assembly according to the invention can freely extend outward by cooperating upper plate (3*a*) and lower plates (3*b*) of base (3) (as shown in FIG. 2*c*).

Thus-formed inkpad assembly accordingly contains following effects:

1) bottom plate (21*e*) of inkpad bases (2) and side plates (21*a*), (21*b*), (21*c*) and (21*d*) can serve as user's force-applying points to grasp inkpad bases (2) thus there are many force-applying points facilitating user to operate;

2) when the user applies color of inkpad (1) on one inkpad base (2) to a canvas, side plates (21*a*), (21*b*), (21*c*) and (21*d*) of inkpad bases (2) can prevent the user's hands from staining by the color of inkpad (1); and 3) hollow receptacle (21) formed by side plates (21*a*), (21*b*), (21*c*) and (21*d*) of each inkpad base (2) can prevent the ink which is not accommodated in inkpad (1) from staining base (3).

Furthermore, when a multi-color inkpad assembly formed by several inkpad bases (2), following effects are achieved:

4) color staining between inkpads (1) in neighboring inkpad bases (2) is prevented by side plates (21*a*), (21*b*), (21*c*) and (21*d*) of inkpad bases (2).

If more than three inkpad bases (2) are assembled to form a multicolor inkpad assembly (a'), the invention is embodied with base (3) formed by bottom upper plate (3*a*) cooperating with lower plate (3*b*), following effects are achieved according to the operation of the first, second and third rotatable axles:

5) inkpad assembly contains extend-to-open function and retract-to-close function; when it extends to open the user can easily grasp it to use and when it retract to close it is easily to store and carry and further adding pattern variation of the inkpad assembly.

Hollow receptacle (25) formed by side plates (21*a*), (21*b*), (21*c*) and (21*d*) of each inkpad bases (2) is not limited to accept ink-absorbent material such as sponge. That is, inkpad (1) can accept other esthetical colorants such as famille rose colorants. Thus, following effects are achieved in the inkpad assembly according to the invention:

6) it can serve as an esthetical palette.

The above-described inkpad assembly is one preferred embodiment according to the invention and is not intended to limit the scope of the invention. For example, the amount of the rotatable axles is not limited to be three and the extend-to-open and retract-to-close functions can be achieved by two rotatable axles. The configuration of inkpad bases (2) can be freely varied to cooperate with variant configurations of upper plates (3*a*) and lower plates (3*b*) of base (3) and thus the inkpad assembly according to the invention can have variant configurations. Therefore, the appearance and configuration of the inkpad assembly according to the invention is not limited the described preferred embodiment.

Though the present invention has been particularly shown and described above with reference to the preferred embodiment, it is anticipated that alterations and modifications thereof will no doubt become apparent to those skilled in the art. It is therefore intended that the following claims be interpreted as covering all such alteration and modifications as fall within the true spirit and scope of the present invention.

What is claimed is:

1. A telescopic multi-color inkpad assembly with ease-demountable-and-assembled inkpad bases, comprising:

inkpad bases each being provided with a cubic hollow receptacle formed by bottom plate and side plates thereof, a slit formed on an outside face of each of more than two of the side plates and a protrusion formed in a curved recession associatedly serving as a sliding trail, wherein when several inkpad bases are arranged together adjacent to each other, the side plates of the inkpad bases can prevent color spreading between neighboring inkpad bases;

inkpads each being accommodated in the hollow receptacle of a base being provided for each inkpad base;

a base being provided with upward protruding side plates to form a hollow slot so shaped to correspond to a shape of each inkpad base, a protrusion formed on an inward face of each of two of the side plates of the base facing the hollow slot of the base to cooperate with the corresponding slit, serving as a sliding trail so that the inkpad bases can be freely demounted from or assembled to the base along an axis direction of the sliding trail; and a cover being provided with a configuration that can cooperate with inkpad bases to prevent evaporation of ink.

2. The telescopic multi-color inkpad assembly with ease-demountable-and-assembled inkpad bases according to claim 1, wherein said protrusion of each inkpad base serves as a handle.

3. The telescopic multi-color inkpad assembly with ease-demountable-and-assembled inkpad bases according to claim 1, wherein said curved recession is formed on the outside face of one of the side plates of each inkpad base to serve as a force applying point being used when the inkpad bases are demounted from the base.

4. The telescopic multi-color inkpad assembly with ease-demountable-and-assembled inkpad bases according to claim 1, wherein the inkpad is formed by adding ink in a water-absorbent body and can be freely demounted from the hollow receptacle of each inkpad base.

5. The telescopic multi-color inkpad assembly with ease-demountable-and-assembled inkpad bases according to claim 1, wherein the inkpad is a solid colorant.

6. The telescopic multi-color inkpad assembly with ease-demountable-and-assembled inkpad bases according to claim 1, wherein the base comprising:

more than three upper plates each containing an upward protruding side plate of the base to form a slot so shaped to correspond to the configuration of the inkpad bases, each upper plate containing a first axle, a second axle and a third axle thereon; and more than three lower plates each containing a first axle, a second axle and a third axle;

wherein one upper plate cooperates with three lower plates to form a first rotatable axle by connecting the first axle of the upper plate to the first axle of one lower plate, a second rotatable axle by connecting the second axle of the upper plate to the second axle of the other lower plate, and a third rotatable axle by connecting the third axle of the upper plate to the third axle of another lower plate so that the upper plate and the lower plates of the base are so interconnected that when the rotatable axles rotate the base can extend outward to open or retract inward to close according to the upper and the lower plates.

7. The telescopic multi-color inkpad assembly with ease-demountable-and-assembled inkpad bases according to claim 6, wherein amount of rotatable axles formed by the upper plate and the lower plates of the base is two.

* * * * *